US005211405A

United States Patent [19]

Shelton et al.

[11] Patent Number: 5,211,405

[45] Date of Patent: May 18, 1993

[54] DART BOARD GAME CABINET

[75] Inventors: Richard B. Shelton, Bay City; Bruce D. Allen, Saginaw, both of Mich.

[73] Assignee: Valley Recreation Products Inc., Bay City, Mich.

[21] Appl. No.: 770,598

[22] Filed: Oct. 3, 1991

[51] Int. Cl.[5] ..... F41J 3/00

[52] U.S. Cl. ..... 273/407; 312/249.7

[58] Field of Search ..... 273/407, 403, 404, 406, 273/408; 312/249.7

[56] References Cited

U.S. PATENT DOCUMENTS 4,057,251 11/1977 Jones et al. ..... 273/408 X

FOREIGN PATENT DOCUMENTS 2539640 7/1984 France ..... 273/404

520021 4/1940 United Kingdom ..... 273/404

*Primary Examiner*—William H. Grieb

*Attorney, Agent, or Firm*—Learman & McCulloch

[57] ABSTRACT

A game cabinet has lower and upper housings hinged to one another to enable the upper housing to be swung from a position atop the lower housing to a position alongside and parallel to the lower housing. A target assembly having a frame and a plurality of individual segments removably accommodated in spaces formed by dividers is swingable as a unit about a horizontal axis to provide access to the segments from the rear of the assembly. The segments are biased in one direction by a resilient pad when the target assembly is in an operative position and the biasing force exerted by the pad is adjustable.

20 Claims, 4 Drawing Sheets

DART BOARD GAME CABINET

This invention relates to a cabinet for providing support for a game such as an electronically scored dart game.

BACKGROUND OF THE INVENTION

Electronically scored dart games conventionally are housed in a cabinet on which is supported a target having segments adapted to be displaced when struck by a thrown dart and electronic circuitry responsive to displacement of any of the segments to actuate a scoring mechanism. The cabinet conventionally supports not only the target and scoring mechanism, but also houses electronic circuitry, various displays, instructions for playing any selected one of a number of different dart games, selecting means for selecting the game that is to be played, audio-visual apparatus, a coin controlled operating mechanism, and the like.

Some of the dart games of the kind to which the invention relates have so-called spiders forming spaces in which individual target segments are positioned and removably retained. Some of these segments have a plurality of openings therein for the accommodation of the tip of a thrown dart so as to capture the dart. If a dart is thrown at high velocity, the tip may become so firmly wedged in an opening of a segment that considerable force must be exerted on the dart to extract it from the segment. In some cases the force exerted may be sufficient to cause the cabinet to tip, thereby exposing a player to injury and risking damage to the game itself.

In those dart games which utilize darts having plastic tips that are adapted to be accommodated in openings in the target segments, the tips occasionally break and remain embedded in the segments. An embedded tip prevents the tip of a subsequently thrown dart from being captured in the opening occupied by the broken tip, thereby causing the dart to fall to the floor. It is conventional practice, therefore, to remove broken tips from the target segments periodically. This necessitates opening the cabinet to obtain access to the rear of the target segments so as to enable the segments to be removed from the spider or to enable a tool to be inserted in a segment opening and push the broken tip therefrom. In conventional dart games, the target support is mounted for swinging movement about a vertical axis so as to provide access to the rear of the target segments. Unless considerable care is exercised in swinging the target about the vertical axis, some or all of the segments may fall out of the spider, thereby necessitating a tedious, time consuming replacement of such segments.

Dart games of the general class to which the invention relates often are placed in taverns for the amusement of patrons. It is not uncommon for beverages accidentally to be spilled on the cabinet in which the dart game is housed, and sometimes the beverage finds its way into the interior of the cabinet resulting in damage to the electrical circuitry.

Cabinets of the kind associated with electronically scored dart games conventionally are relatively tall and narrow, thereby resulting in a somewhat unstable unit that is especially difficult to maintain upright during shipment.

Apparatus constructed in accordance with the invention overcomes all of the problems referred to above.

SUMMARY OF THE INVENTION

A cabinet adapted for use in supporting an electronically scored dart game comprises a lower housing, an upper housing, and means hinging the upper housing to the lower housing for swinging movements of the upper housing about a horizontal axis so as to enable the upper housing to be moved between a first position in which it rests atop the lower housing to a second position in which it extends alongside and parallels the lower housing. The lower housing has a base which is of such size as to provide stability to the cabinet when the upper housing is atop the lower housing, and the base is provided with adjustable means for leveling the cabinet.

The lower housing is provided with space for the accommodation of the necessary electrical components and coin control mechanism for initiating operation of the electrical components. The lower housing is provided with means for minimizing the possibility that liquids may gain access to the electrical circuitry accommodated in the housing The upper housing supports a game target and scoring indicators. The target comprises a rigid backing member fixed to the upper housing and on which is secured a membrane or other suitable matrix switch member. Hinged to the backing member for swinging movements about a horizontal axis is a target supporting frame having an opening therein for the accommodation of a spider having dividers forming a plurality of spaces for individual target segments. Between the switch member and the target supporting frame is a biasing member upon which the target segments seat and which biases them constantly, but yieldably, in a direction away from the switch member. The target supporting frame is adjustable relative to the backing member so as to vary the force which the biasing member exerts on the target segments.

The horizontal axis about which the target supporting frame may rock is at the lower edge of the target, thereby enabling the assembly of the target supporting frame, the spider, and the target segments to be swung as a unit in such direction as to avoid any likelihood that any of the target segments inadvertently will be displaced from the spider.

The lower housing is configured in such manner that the target assembly can he supported in a an inclined position in which each segment is accessible, but is not susceptible to falling out of its space due to gravity.

THE DRAWINGS

A cabinet constructed in accordance with a preferred embodiment of the invention is disclosed in the accompanying drawings wherein.

Figure 4:
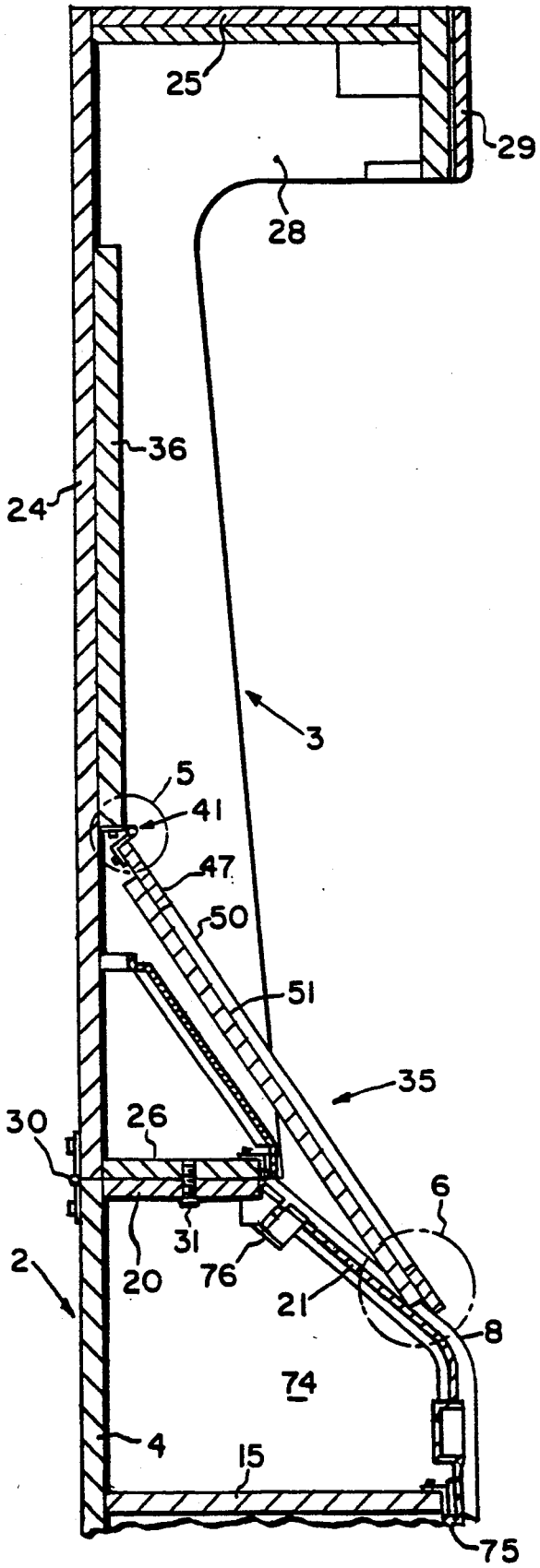
FIG. 4 is an enlarged, fragmentary, sectional view illustrating the dart target supporting frame in an adjusted position.
Figure 5:
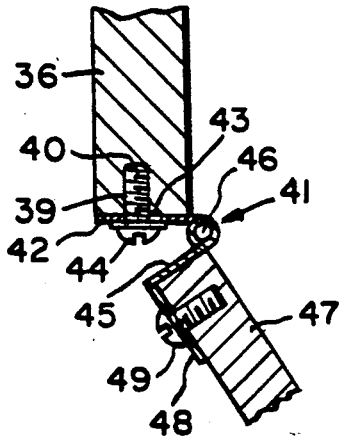
Figure 6:
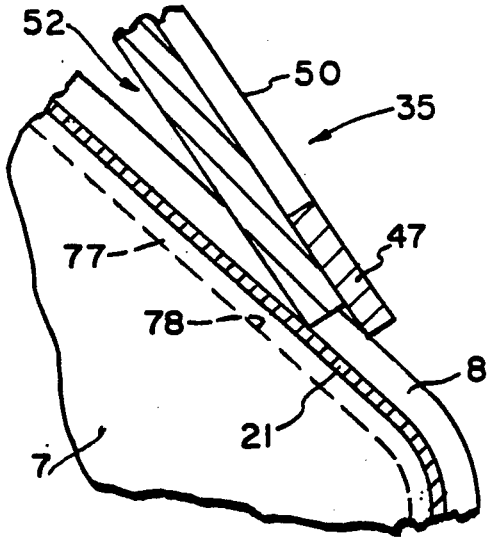
Figure 8:
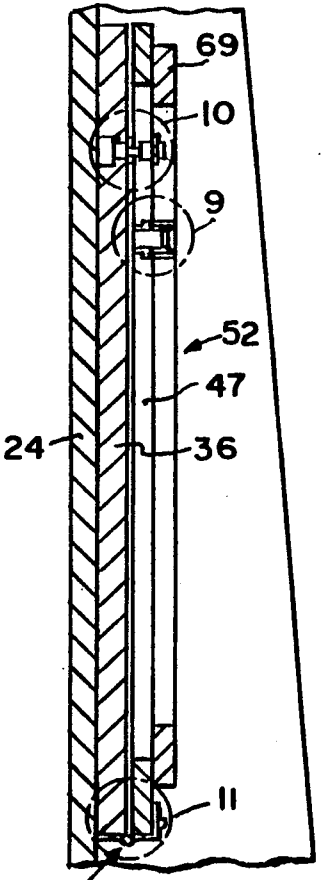
Figure 7:
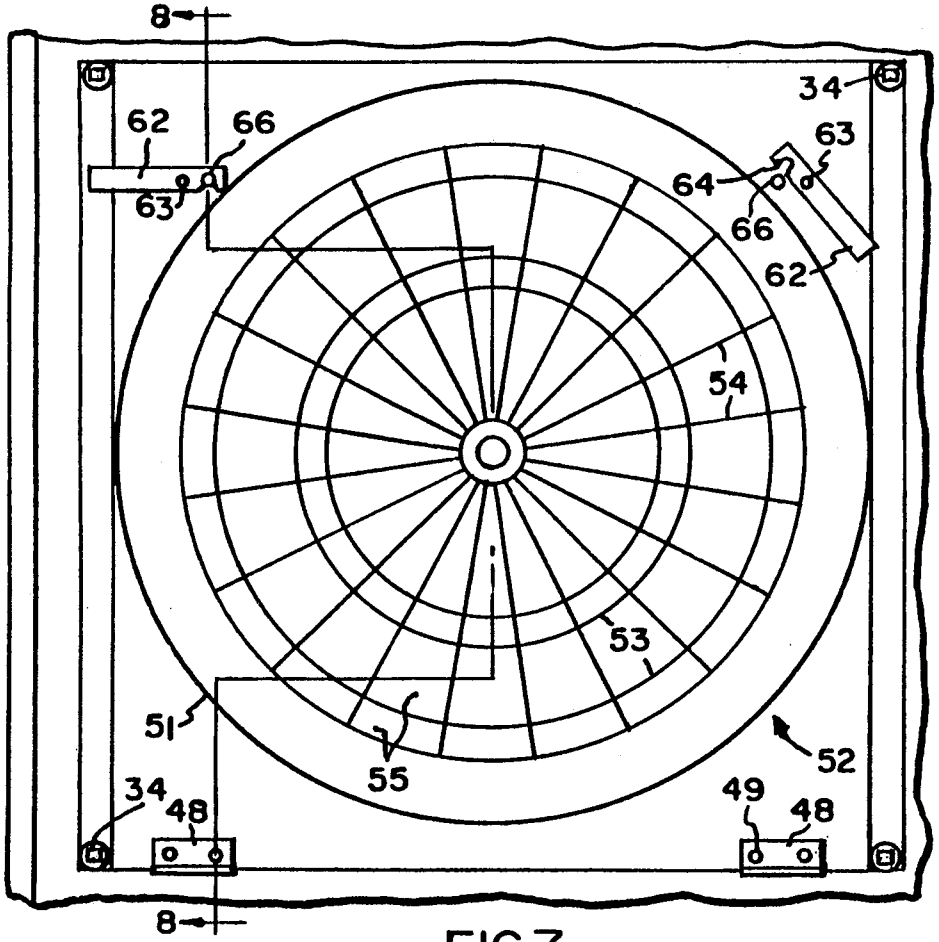

FIGS. 5 and 6 are enlarged, sectional views of details identified by the circles 5 and 6, respectively, in FIG. 4;

FIG. 7 is an enlarged, fragmentary, elevational view of the target supporting frame and target;

FIG. 8 is a sectional view taken on the line 8—8 of FIG. 7; and

Figure 9:
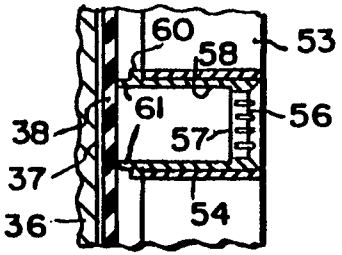
Figure 10:
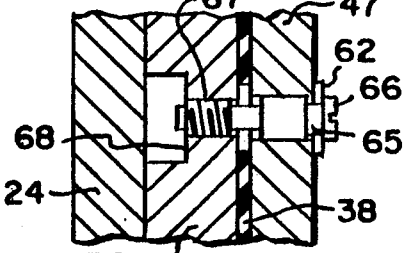
Figure 11:
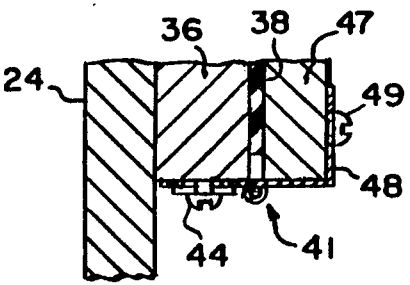

FIGS. 9, 10, and 11 are enlarged sectional views of the details identified by the circles 9, 10, and 11, respectively, in FIG. 8.

THE DISCLOSED EMBODIMENT

A cabinet constructed in accordance with the presently preferred embodiment of the invention is designated generally by the reference character 1 and comprises a lower housing 2 and an upper housing 3. The lower housing 2 has a rear wall 4, a front wall 5, a bottom wall 6 and two side walls 7, each of which has an extension 8 projecting beyond the front wall 5. The lower housing 2 is secured to a base 9 having an upper wall 10 which parallels but is spaced from the bottom wall 6. The wall 6 and the wall 10 have aligned openings 11 and 12, respectively, through which electrical wiring (not shown) may pass. The base also is fitted with adjustable leveling screws 13 by means of which the cabinet 1 may be leveled when it is supported on a floor 14 or other structure.

The lower housing 2 has an intermediate wall 15 on which is supported a microprocessor 16. The front wall 5 of the lower housing has an opening 17 for the accommodation of one or more coin slides 18 and a coin container accessible via a lockable door 19.

The lower housing 2 also has an upper, horizontal wall 20 which is relatively shallow in depth. Spanning the walls 15 and 20 is a cover 21 on which game instructions may be printed.

Figure 1:
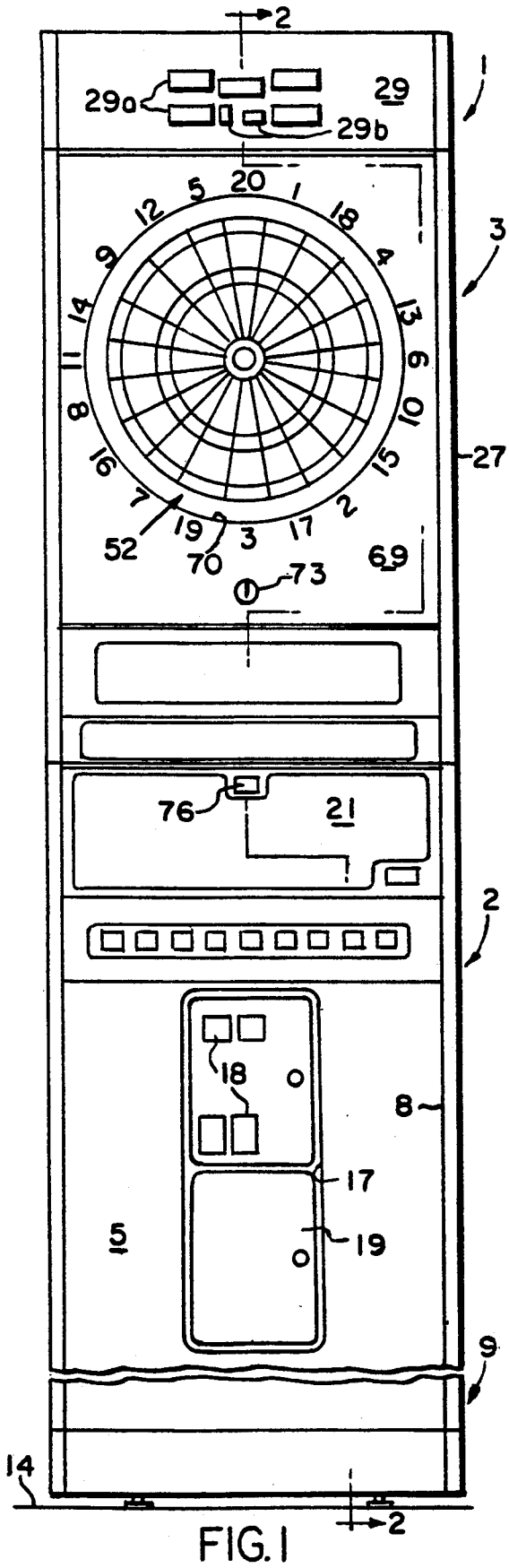
FIG. 1 is a fragmentary, front elevational view.
Figure 2:
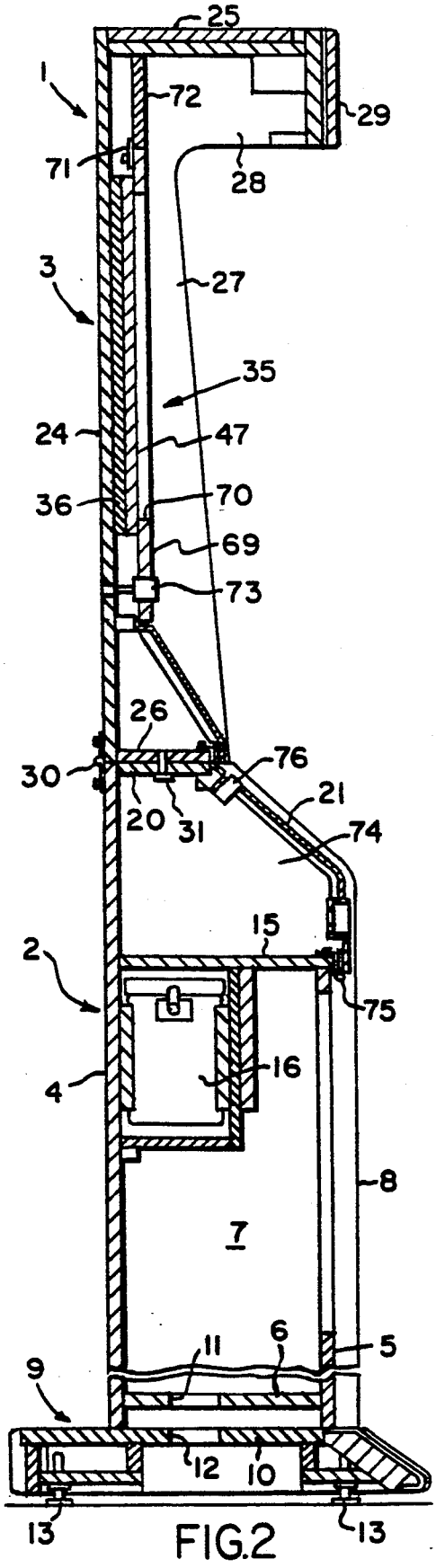
FIG. 2 is a transverse sectional view.
Figure 3:
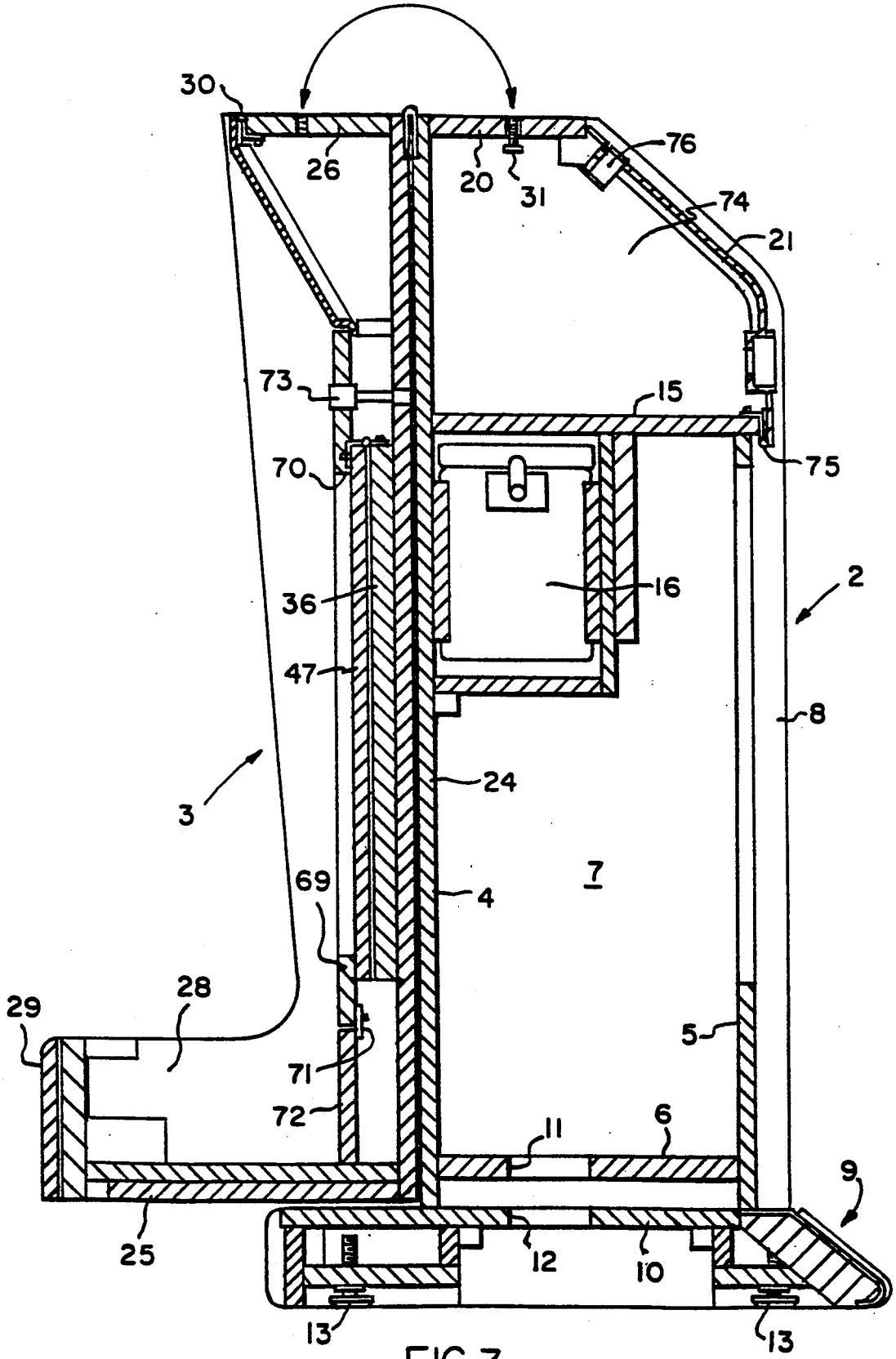
FIG. 3 is an enlarged transverse sectional view illustrating the upper and lower housings in adjusted positions.

The upper housing 3 has a rear wall 24, a top wall 25, a bottom wall 26, and two side walls 27 which have forwardly projecting extensions 28 at their upper ends spanned by a panel 29 on which scoring and other indicators 29*a* and 29*b* are mounted. The bottom wall 26 corresponds in size to the top wall 20 of the lower housing 2. A hinge 30 pivotally joins the back walls 4 and 24 of the upper and lower housings so as to enable the upper housing 3 to be swung from an upright position, as shown in FIGS. 1 and 2 in which it rests atop the lower housing 4, to an adjusted position, as shown in FIG. 3, in which the upper housing lies alongside of and parallel to the lower housing 2. When the upper housing is in its upright position, it is secured to the lower housing by a plurality of retaining bolts 31 which clamp the walls 20 and 26 to one another.

A target assembly 35 is supported by the upper housing 3 and comprises a rigid backing member 36 which is secured to the inner surface of the back wall 24 by means of screws 34. Secured to the exposed face of the backing member 36 is a matrix switch 37 (best shown in FIGS. 9–11) of the kind shown in U.S. Pat. No. 4,836,556. Overlying the switch 37 is a biasing member or pad 38 formed of resiliently compressible, elastomeric material and corresponding to that shown in the above identified patent. The lower edge of the backing member 36 is provided with a plurality of openings 39 (FIG. 5) for the accommodation of a corresponding plurality of screws or bolts 40. A hinge 41 has one leaf 42 confronting and secured to the lower edge of the backing member 36. The leaf 42 has an elongate slot 43 through which the shank of the bolt 40 passes. Each bolt 40 has a head 44 which is sufficiently larger than the slot 43 to preclude passage of the head through the slot. The slots 43 enable the hinge 41 to be adjusted toward and away from the rear wall 24 of the housing for a purpose presently to be explained.

The hinge 41 has a second leaf 45 joined to the leaf 42 by a conventional hinge pin assembly 46 which establishes a substantially horizontal axis of rotation at the lower end of the backing member 36. The hinge leaf 45 overlies the lower edge of a target supporting frame 47 and has a flange 48 which bears against one face of the frame 47. Headed bolts or screws 49 secure the hinge 41 to the frame 47 via openings in the flange 48.

The frame 47 has an opening 50 therein which is encircled by an annular frame 51 that supports a spider 52 corresponding to that shown in the above identified patent and having a plurality of concentric and radial ribs or dividers 53 and 54, respectively, which together define spaces in which individually movable target segments 55 are accommodated. See FIG. 7. The spaces overlie and are in register with the opening 50. Each segment has an outer face 56 provided with a plurality of openings 57 and side walls 58 which fit within the spaces. Each segment has retaining lugs 60 which underlie the ribs 53 and 54 so as to limit movement in one direction of the segment. Each segment also has projecting feet 61 which bear against the biasing member 38. The biasing member 38 thus constantly urges each segment in a direction toward the right, as viewed in FIG. 9, but is sufficiently yieldable to enable the segment, when contacted by a thrown dart, to move to the left whereby the feet 61 compress the biasing member and effect operation of the matrix switch 37.

The target supporting frame 47 normally occupies the position shown in FIGS. 2, 7, and 8 in which it is adjacent and parallel to the backing member 36. The frame is maintained in such position by a pair of levers 62 rockably mounted on pivot pins 63 that are secured to and project from the backing member 36. Each lever has a notch 64 that is adapted to receive a necked shank 65 of an adjustable anchor screw 66 which has a threaded end 67 accommodated in a correspondingly threaded opening 68 in the backing member 36. Each screw 66 may be adjusted so that when the notch 64 in the companion link 62 accommodates the shank 65, the compression to which the biasing member 38 is subjected may be varied. The compression to which the biasing member is subjected may be equalized over the entire area of the backing member by adjustment of the screws 66 and the hinges 41. Thus, the biasing force exerted by the biasing member 38 on all of the target segments may be controlled.

Unauthorized access to the target and its bias adjusting means is prevented by a security panel 69 having a central opening 70 therein which overlies the frame 47. The spider 52 is accommodated in the opening 70. The panel 69 has retaining lugs 71 along its upper edge which underlie a rail 72 which spans the side walls 27 adjacent the upper end of the housing 3. A key operated locking screw 73 is carried by the panel 69 and is anchored on the back wall 24 of the housing. The panel may be removed by unlocking the screw 73 and swinging the lower end of the panel to the right, as viewed in FIG. 2, so as to enable the retaining lugs 71 to be removed from beneath the rail 72.

When the panel 69 is removed, as is shown in FIG. 4, the links 62 may be disengaged from the anchor screws 66, thereby enabling the assembly of the frame 47, the spider, and the segments to be swung as a unit clockwise through an arc of more than 90° but less than 180° to the inclined position shown in FIG. 4. The clockwise movement of the assembly is limited by the engagement of the free upper edge of the frame 47 with the extensions 8 of the side walls 7. In this position the target assembly is supported solely by the extensions 8 and the segments are accessible for the purpose of enabling any broken tips to be removed from the segments. Throughout the movement of the frame and target between the positions shown in FIGS. 2 and 4, the gravitational forces exerted on the segments do not tend to separate them from the spider.

The horizontal walls 15 and 20 of the lower housing 2 form a compartment 74 in which various electrical components may be located. Preferably, the cover 21 is rockably connected at its lower end to the wall 15 by means of a hinge 75. A locking screw assembly 76 is provided at the upper end of the wall 21 for releasably locking the latter in a position in which the cover closes the compartment 74. The cover 21 preferably has side flanges 77 which are accommodated in grooves 78 in the side walls 7 so as to minimize the likelihood that spilled liquids may enter the compartment when the cover is closed.

When the game is in condition for use, the upper housing will be supported atop the lower housing, as shown in FIGS. 1 and 2, and the security panel 69 will be in place, as is shown in FIGS. 1 and 2, thereby enabling any one of a number of different dart games to be selected and played by one or more players.

When it is desired to service the apparatus, the security panel 69 can be removed and the target assembly swung to the position shown in FIG. 4 so as to provide access to the target segments. The target assembly then may be returned to its upright position, whereupon the cover 21 may be opened to gain access to the contents of the compartments 74. Access to the coins may be obtained through the door 19.

When the apparatus is to be shipped or stored, the bolts 31 may be removed, following which the upper housing 3 may be swung counterclockwise from the position shown in FIG. 2 to the position shown in FIG. 3. This will reduce greatly the overall height of the cabinet, thereby making it less susceptible to tipping. If desired, the levelling screws 13 may be adjusted to enable the bottom of the base to bear against its supporting surface, but it is preferable to adjust the screws 13 to provide a clearance between the bottom of the base and the supporting surface through which the forks of a forklift truck may pass for ease of transport.

The disclosed embodiment is representative of a presently preferred form of the invention, but is intended to be illustrative rather than definitive thereof. The invention is defined in the claims.

What is claimed is:

1. A cabinet for supporting a game target comprising a lower housing; an upper housing; means coupling said upper and lower housings together for swinging movements of said upper housing about a first, substantially horizontal axis from a first position atop said lower housing to a second position alongside and parallel to said lower housing; a game target; and means mounting said target on said upper housing, said mounting means including a support on which said target is fixed and means mounting said support on said upper housing for swinging movements about a second axis.

2. The cabinet according to claim 1 wherein said support has an upper end and a lower end, said second axis being horizontal and adjacent the lower end of said support.

3. The cabinet according to claim 2 wherein said support is swingable about said second axis through at least 90° but less than 180°.

4. The cabinet according to claim 1 wherein said target comprises a backing member; a frame secured to said backing member and defining a plurality of spaces; a plurality of independent segments corresponding to the plurality of said spaces and accommodated in said spaces for reciprocating movements therein; resilient biasing means for urging said segments in a direction outwardly of said spaces; retaining means reacting between said frame and said segments for limiting movement thereof in said direction; and means reacting between said backing member and said frame for maintaining said segments in such positions that said biasing means constantly exerts a force on said segments to bias them in said direction.

5. The cabinet according to claim 4 including adjusting means for adjusting the biasing force exerted by said biasing means on said segments.

6. The cabinet according to claim 1 including a base underlying and supporting said lower housing; and adjustable leveling means carried by said base for leveling said lower housing.

7. A cabinet for supporting a game target comprising a lower housing; an upper housing; mean coupling said upper and lower housings together for swinging movements of said upper housing about a substantially horizontal axis from a first position atop said lower housing to a second position alongside and parallel to said lower housing; a game target; and means mounting said target on said upper housing, said target comprising a backing member, a frame secured to said backing member and defining a plurality of spaces, a plurality of independent segments corresponding to the plurality of said spaces and accommodated in said spaces for reciprocating movements therein, resilient biasing means for urging said segments in a direction outwardly of said spaces, retaining means reacting between said frame and said segments for limiting movement thereof in said direction, and means reacting between said backing member and said frame for maintaining said segments in such positions that said biasing means constantly exerts a force on said segments to bias them in said direction.

8. Supporting apparatus for a dart game target comprising an upright backing member; a target having divider means defining a plurality of separate spaces and a corresponding plurality of independent target segments movably accommodated in said spaces; target mounting means overlying said backing member and having an opening therein; means securing said divider means to said mounting means with said segments overlying said opening; retaining means reacting between said divider means and said segments for limiting movement of said segments in a direction away from said backing member; means for latching said mounting means in an upright position with said segments accessible to a thrown dart; and hinge means connecting said mounting means at its lower end for swinging movements about a substantially horizontal axis in a direction away from said backing member to provide access to said segments.

9. Apparatus according to claim 8 including means for limiting swinging movement of said mounting means in said direction, and means for supporting said mounting means when the latter is at the limit of its swinging movement.

10. Apparatus according to claim 8 wherein said mounting means is spaced from said backing means when said mounting means is in said upright position.

11. Apparatus according to claim 10 wherein said latching means is adjustable to vary the space between said backing means and said mounting means when the latter is in said upright position.

12. Apparatus according to claim 10 wherein said hinge is adjustable to vary the space between said backing means and said mounting means when the latter is in said upright position.

13. Apparatus according to claim 10 including yieldable biasing means occupying said space between said backing member and said mounting means for urging said segments in said direction.

14. Apparatus according to claim 13 wherein said biasing means is fixed to said backing member.

15. Apparatus according to claim 8 comprising a housing on which said backing member is secured, said housing having at a level below that of said hinge means a compartment having an open side; a closure carried by said housing for movements between first and second positions in which said closure respectively opens and closes said side of said compartment; and limit means carried by said housing at opposite sides of said opening on which said closure seats when said closure is in said second position, said limit means having channels therein alongside opposite sides of said opening for collecting and draining liquid.

16. Apparatus according to claim 15 wherein said closure has flanges at opposite sides thereof and extending alongside said channels when said closure is in said second position.

17. Apparatus according to claim 15 wherein each of said segments has a plurality of openings therein for the accommodation of a dart tip.

18. Supporting apparatus for a dart game comprising upper and lower housings; means pivotally coupling said housings to one another and enabling said upper housing to rock about a horizontal axis from a first position atop said lower housing to a second position parallel to and alongside said lower housing; means for separably locking said housings in said first position; a target supporting frame having an opening therein; a spider carried by said frame and having a plurality of spaces therein in register with said opening; a plurality of movable target segments in said spaces; means reacting between said spider and said segments for limiting movement of said segments in one direction relative to said spider; means mounting said frame for swinging movements about a substantially horizontal axis from a first substantially upright position to a second position inclined to a vertical plane; and biasing means exerting a force on said segments when said frame is in said first position to bias said segments in said one direction, said axis being adjacent the lower edge of said frame.

19. The cabinet according to claim 18 including means for adjusting the force exerted on said segments by said biasing means.

20. The cabinet according to claim 18 wherein each of said segments has a plurality of openings therein.

* * * * *